US006695669B2

(12) United States Patent
Piepenbrink

(10) Patent No.: US 6,695,669 B2
(45) Date of Patent: Feb. 24, 2004

(54) PULL ACTIVATED NOVELTY SOUND DEVICE

(76) Inventor: Arthur W. Piepenbrink, 106 Maple Dr., Waterloo, WI (US) 53594

( * ) Notice: Subject to any disclaimer, the term of this patent is extended or adjusted under 35 U.S.C. 154(b) by 0 days.

(21) Appl. No.: 10/237,474

(22) Filed: Sep. 9, 2002

(65) Prior Publication Data

US 2003/0054728 A1 Mar. 20, 2003

Related U.S. Application Data

(60) Provisional application No. 60/322,006, filed on Sep. 14, 2001.

(51) Int. Cl.[7] ..... A63H 30/00
(52) U.S. Cl. ..... 446/175; 116/81
(58) Field of Search ..... 446/47, 258, 175, 446/242, 265, 484, 71, 76, 81; 116/81, 67 R, 85, 86, 209, 210; 439/489; 340/384.4, 384.7, 384.73, 686.1, 687, 686.4

(56) References Cited

U.S. PATENT DOCUMENTS 3,443,546 A * 5/1969 Couey
4,231,184 A * 11/1980 Corris et al. ..... 46/265
4,791,741 A * 12/1988 Kondo ..... 40/124
4,866,865 A * 9/1989 Yang ..... 40/455
5,163,447 A 11/1992 Lyons ..... 128/844
5,182,872 A 2/1993 Lee et al. ..... 40/152
5,275,285 A 1/1994 Clegg ..... 206/449
5,489,890 A * 2/1996 Moser ..... 340/545
5,648,129 A 7/1997 Lee et al. ..... 428/24
5,786,749 A * 7/1998 Johnson et al. ..... 340/384.7
6,104,306 A * 8/2000 Hogue et al. ..... 340/686.1
6,517,376 B1 * 2/2003 Hwang ..... 439/489

* cited by examiner

*Primary Examiner*—Jacob K. Ackun
*Assistant Examiner*—Jamila Williams
(74) *Attorney, Agent, or Firm*—Donald J. Ersler

(57) ABSTRACT

A pull activated novelty sound device includes a sound generating chip, a sound transducer, a switch, a pull device, a battery, and a housing. The sound generating chip is capable of playing a message, a song, or any other type of sound recording. The sound transducer converts the electrical signal from the sound generating chip into an audible sound. The sound generating chip is powered through the battery. The switch controls the electrical power supplied to the sound generating chip. The sound generating chip, sound transducer, battery, and spring switch are contained in the housing. One end of a pull device is withdrawn from the switch to enable electrical power to be supplied to said sound generating chip to emit audible sound through the sound transducer.

11 Claims, 11 Drawing Sheets

PULL ACTIVATED NOVELTY SOUND DEVICE

CROSS-REFERENCE TO RELATED APPLICATION

This is a utility patent application, taking priority from provisional patent application serial No. 60/322,006 filed on Sep. 14, 2001.

BACKGROUND OF THE INVENTION

1. Field of the Invention

The present invention relates generally to novelty devices and more specifically to a pull activated novelty sound device which emits sound when activated by relative motion between two objects.

2. Discussion of the Prior Art

There are several specific devices on the market which emit sound when actuated in a particular way. U.S. Pat. No. 5,163,447 to Lyons discloses a force-sensitive, sound-playing condom. U.S. Pat. No. 5,182,872 to Lee et al. discloses a sound producing control switch for a picture-frame. U.S. Pat. No. 5,275,285 to Clegg discloses a business card holder with sound generating chip. U.S. Pat. No. 5,648,129 to Leet et al. discloses melodic party-favors. All these devices have one thing in common, a sound device contained within a specific structure.

Accordingly, there is a clearly felt need in the art for a pull activated novelty sound device which will emit sound when a door is opened; a tissue is pulled from a gift bag; a lid is removed from a gift box; and applied to numerous other applications where two objects have relative motion to each other.

SUMMARY OF THE INVENTION

The present invention provides a pull activated novelty sound device which may be activated by moving two objects relative to each other. The pull activated novelty sound device includes a sound generating chip, a sound transducer, a spring switch, a pull device, a battery, and a housing. The sound generating chip is capable of storing and outputing a message, a song, or any other type of audible sound. The sound transducer converts the electrical signal output from the sound generating chip into an audible sound. The sound generating chip is powered through the battery. The spring switch controls the electrical power supplied to the sound generating chip. The spring switch includes a first spring leg and a second spring leg. A normally closed electrical on-off switch may be substituted for the spring switch.

The pull device includes an insulator end, a lengthwise body, and an attachable end. The lengthwise body is preferably a string, but other flexible materials may also be used. The sound generating chip, sound transducer, battery, and spring switch are contained in the housing. A peel-off adhesive is attached to the housing on a surface opposite the pull opening. Normally, the first spring leg contacts the second spring leg. However, when the insulator end of the pull device is inserted between the first and second spring legs, no electrical power flows to the sound generating chip; thus no message electrical signal is sent to the sound transducer.

The pull activated novelty sound device is preferably used in the following manner. A peel-off label is removed from the peel-off adhesive on the housing and the housing is attached to a surface such as a molding adjacent a door. With the insulator end inserted into the spring switch, a non-stick label is removed from a peel-off adhesive which is formed on the attachable end. The attachable end is fastened to the door. When the door is opened, the insulator end will be pulled out of the spring switch. The sound generating chip will send an electrical signal to the transducer chip which will emit an audible sound.

Accordingly, it is an object of the present invention to provide a pull activated novelty sound device which emits sound when activated by the movement of two objects relative to each other.

These and additional objects, advantages, features and benefits of the present invention will become apparent from the following specification.

DETAILED DESCRIPTION OF THE PREFERRED EMBODIMENTS

Figure 1:
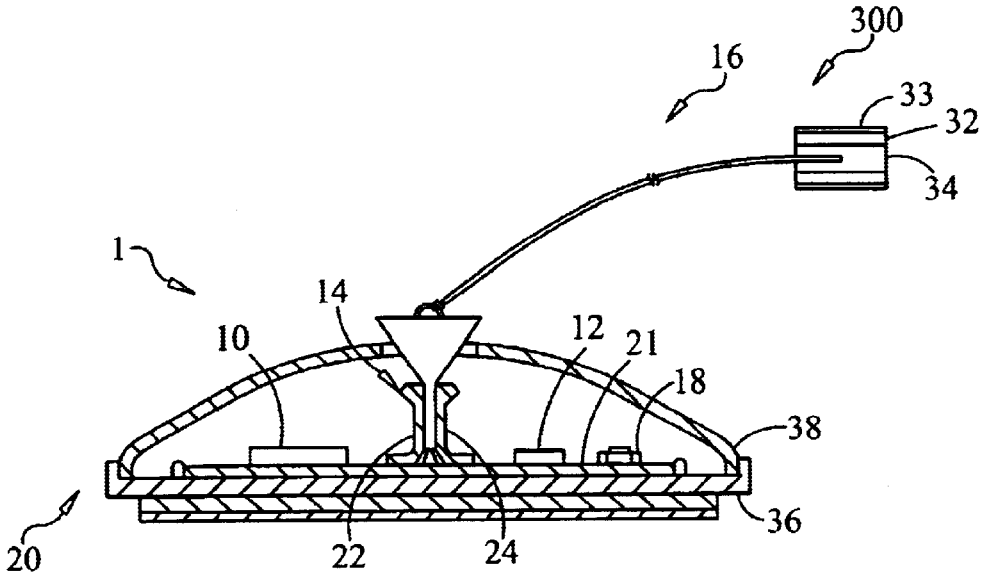
FIG. 1 is a cross sectional view of a pull activated novelty sound device in accordance with the present invention.
Figure 2:
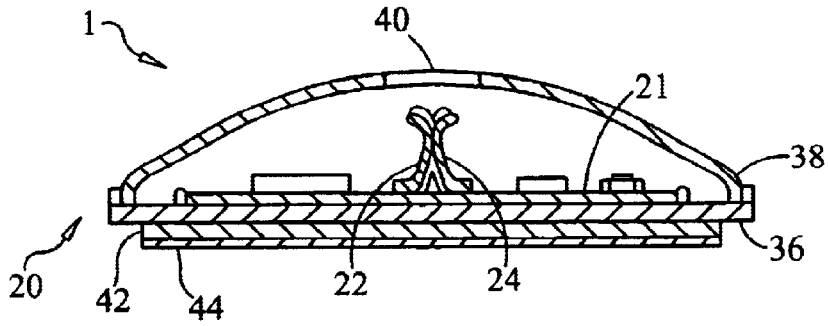
FIG. 2 is a cross sectional view of a pull activated novelty sound device with a pull device removed from a spring switch in accordance with the present invention.
Figure 3:
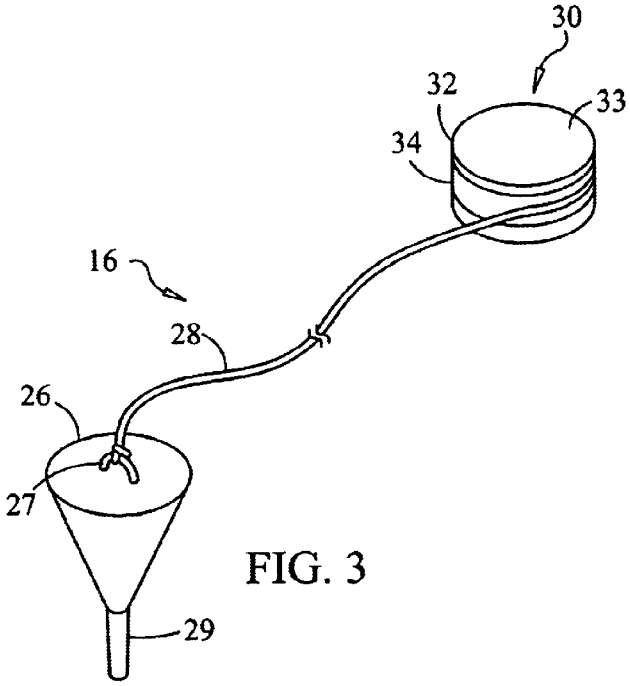
FIG. 3 is an enlarged perspective view of a pull device of a pull activated novelty sound device in accordance with the present invention.
Figure 4:
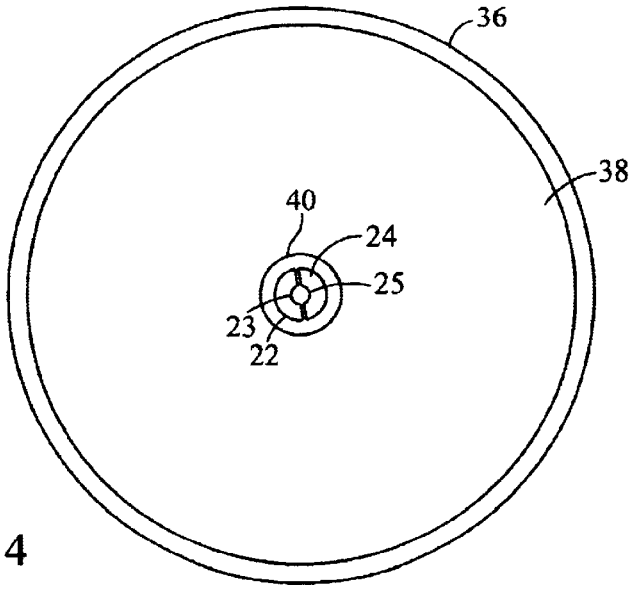
FIG. 4 is a top view of a pull activated novelty sound device in accordance with the present invention.

With reference now to the drawings, and particularly to FIG. 1, there is shown a cross sectional view of a pull activated novelty sound device 1. With reference to FIGS. 2–4, the pull activated novelty sound device 1 includes a sound generating chip 10, a sound transducer 12, a spring switch 14, a pull device 16, a battery 18, and a housing 20. The sound generating chip 10 is capable of storing and outputing a message, a song, or any other type of audible sound. The sound transducer 12 is connected to an electrical output of the sound generating chip 10. The sound transducer converts the electrical signal from the sound generating chip 10 into an audible sound. The sound transducer 12 may be a speaker, a piezo electric device, or any other device which converts an electrical signal into a sound wave. The sound generating chip 10 receives electrical power from the battery 18. The electrical connections between the sound generating chip 10, the sound transducer 12 and the battery 18 are preferably implemented through a circuit board 21. The spring switch 14 controls the electrical power supplied to the sound generating chip 10. The spring switch 14 includes a first spring leg 22 and a second spring leg 24.

The pull device 14 includes an insulator end 26, a lengthwise body 28, and an attachable end 30. The attachable end 30 includes at least one piece of peel-off adhesive 32 which is attached to a body end 34. A peel-off label 33 covers the adhesive surface of the peel off adhesive 32. The attachable end 30 is shown as having a round perimeter, but other shapes may also be used. One end of the lengthwise body 28 is preferably tied to an eye loop 27 formed on one end of the insulator end 26 and the other end of the lengthwise body 28 is attached to the body end 34 with adhesive or any other suitable attachment method. Other methods of attaching the lengthwise body to the insulator end 26 may also be used such as adhesive. The lengthwise body 28 is preferably a string, but other flexible materials may also be used.

A shank portion 29 is formed on the other end of the insulator end 26. A first curved area 23 is preferably formed on an inside perimeter of the first spring leg 22 and a second curved area 25 is preferably formed on an inside perimeter of the second spring leg 24. The first and second curved areas are sized to receive the shank portion 29. Normally, the first spring leg 22 contacts the second spring leg 24. However, when the insulator end 26 of the pull device 16 is inserted between the first and second spring legs, no electrical power flows to the sound generating chip 10; thus no electrical signal is output to the sound transducer 12.

Figure 3A:
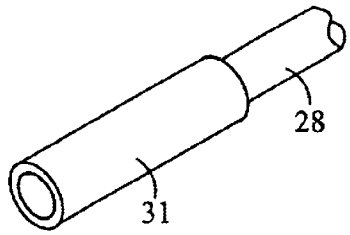
FIG. 3*a* is an enlarged perspective view of an alternative insulator end of a pull device of a pull activated novelty sound device in accordance with the present invention.

With reference to FIG. 3*a*, an insulator tube 31 is formed on an end of the lengthwise body 28 instead of a insulator end 26. The insulator tube 31 is preferably a plastic tube secured to the end of the lengthwise body 28. The insulator tube 31 has sufficient stiffness to allow its insertion into the spring switch 14.

The housing 20 preferably includes a first housing half 36, which mates with a second housing half 38. An insulator opening 40 is formed through the second housing half 38 which facilitates the insertion of the shank 29 into the spring switch 14. The circuit board 21 is preferably attached to a top of the first housing half 36 and a peel-off adhesive 42 is attached a bottom of the first housing half 36. A peel-off label 44 covers the adhesive surface of the peel-off adhesive 42.

Figure 5:
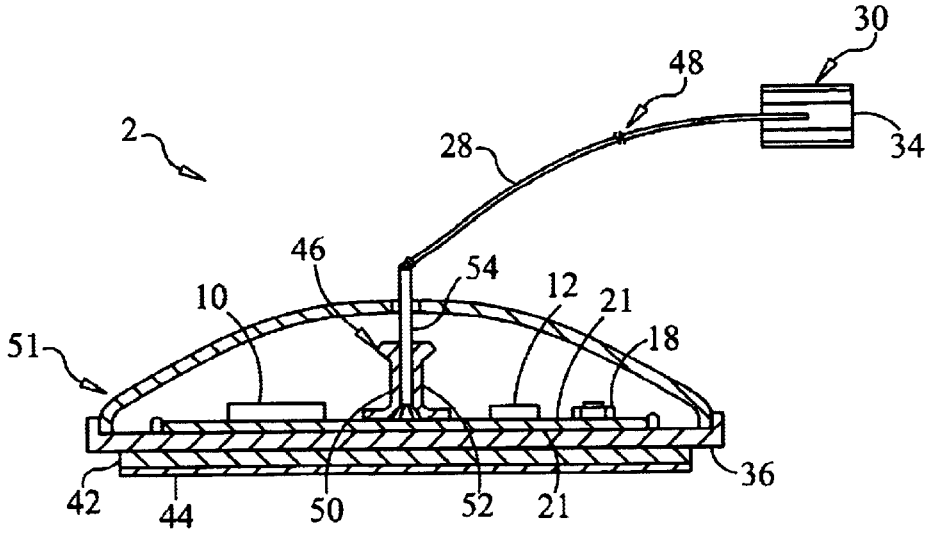
FIG. 5 is a cross sectional view of a second embodiment of a pull activated novelty sound device in accordance with the present invention.
Figure 6:
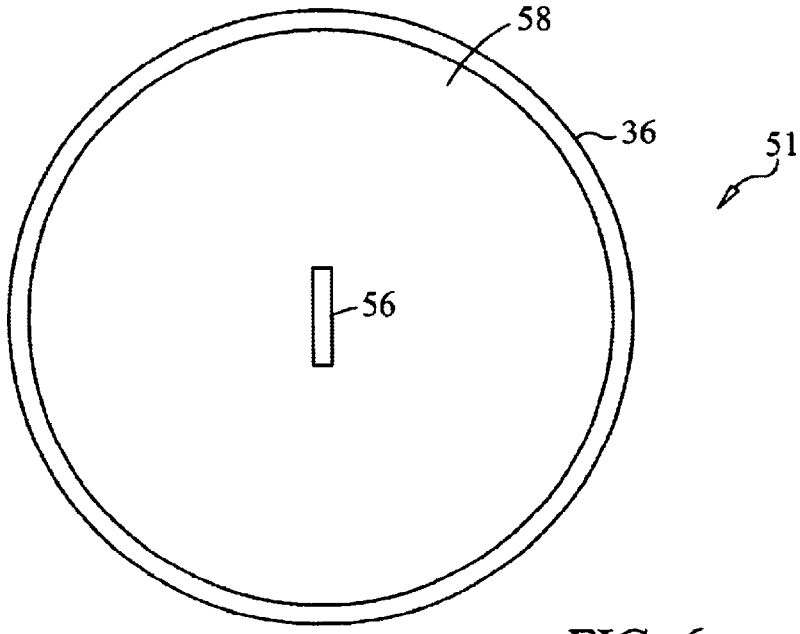
FIG. 6 is a top view of a second embodiment of a pull activated novelty sound device in accordance with the present invention.
Figure 7:
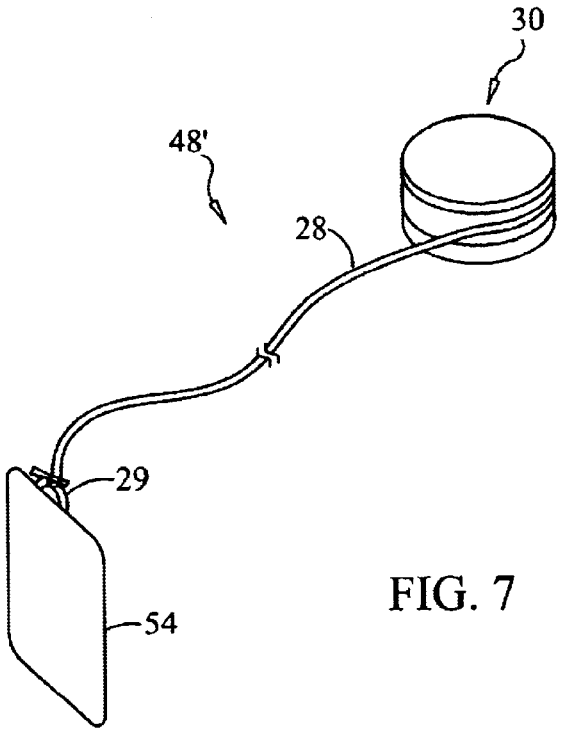
FIG. 7 is an enlarged perspective view of a pull device of a second embodiment of a pull activated novelty sound device in accordance with the present invention.

With reference to FIGS. 5–7, a second embodiment of a pull activated novelty sound device 2 includes the sound generating chip 10, the sound transducer 12, a spring switch 46, a pull device 48, the battery 18, and a housing 51. The sound generating chip 10, sound transducer 12, and the battery 18 operate in the same manner as they do in the pull activated novelty sound device 1. The spring switch 46 controls the electrical power supplied to the sound generating chip 10. The spring switch 46 includes a first spring leg 50 and a second spring leg 52.

The pull device 48 includes an insulator end 54, the lengthwise body 28, and the attachable end 30. The only difference between the pull device 14 and the pull device 48 is the insulator end 54. The insulator end 54 is a nonconductive flexible sheet. One end of the lengthwise body 28 is preferably tied to an eye loop 29 formed on one end of the insulator end 54 and the other end of the lengthwise body 28 is attached to the body end 34 with adhesive or any other suitable attachment method. Other methods of attaching the lengthwise body 28 to the insulator end 54 may also be used such as adhesive. The lengthwise body 28 is preferably a string, but other flexible materials may also be used.

The first spring leg 50 and the second spring leg 52 do not contain a curved area as do the first spring leg 22 and the second spring leg 24. An insulator opening 56 is formed over the first spring leg 50 and the second spring leg 52 as in the pull activated novelty sound device 1. Normally, the first spring leg 50 contacts the second spring leg 52. However, when the insulator end 54 of the pull device 48 is inserted between the first spring leg 50 and the second spring leg 52, no electrical power flows to the sound generating chip 10; thus no message electrical signal is sent to the sound transducer 12.

Figure 8:
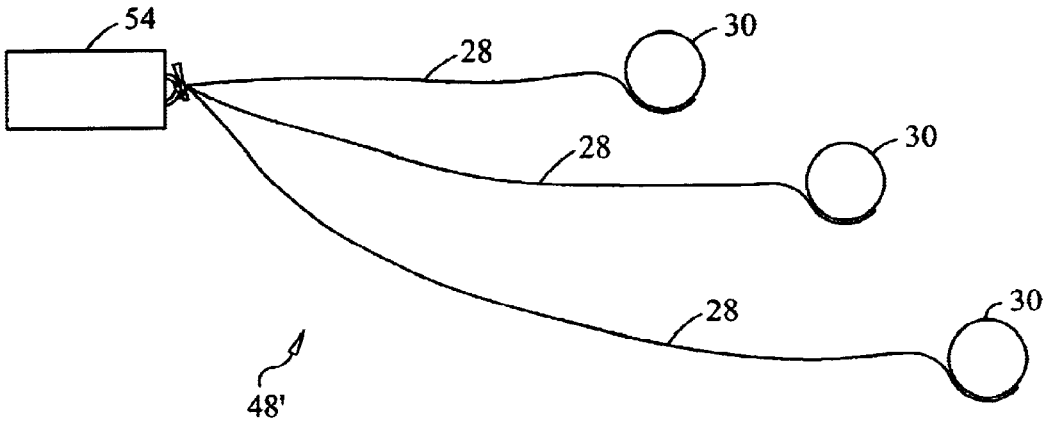
FIG. 8 is a top view of a second embodiment of a pull device with multiple lengthwise bodies in accordance with the present invention.

The housing 51 preferably includes the first housing half 36 which mates with a second housing half 58. The insulator opening 56 is formed through the second housing half 58. The circuit board 21 is preferably attached to a top of the first housing half 58 and a peel-off adhesive 42 is attached to a bottom of the first housing half 36. A peel-off label 44 covers the adhesive surface of the peel off adhesive 42. With reference to FIG. 8, a pull device 48' includes an insulator end 54, at least two lengthwise bodies 28, and at least two attachable ends 30. The lengthwise bodies 28 have varying lengths for attachment in different applications.

Figure 9:
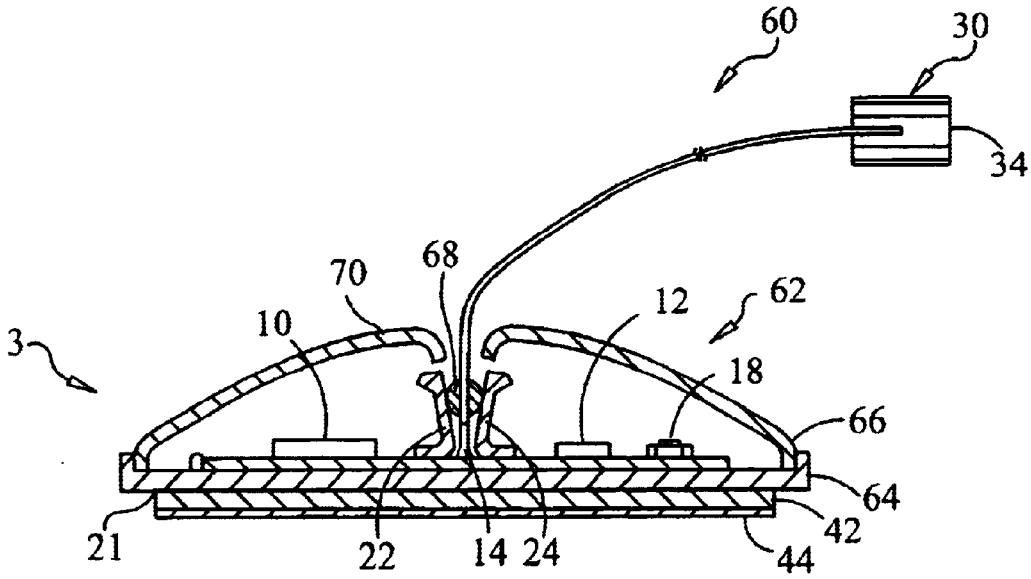
FIG. 9 is a cross sectional view of a third embodiment of a pull activated novelty sound device in accordance with the present invention.
Figure 10:
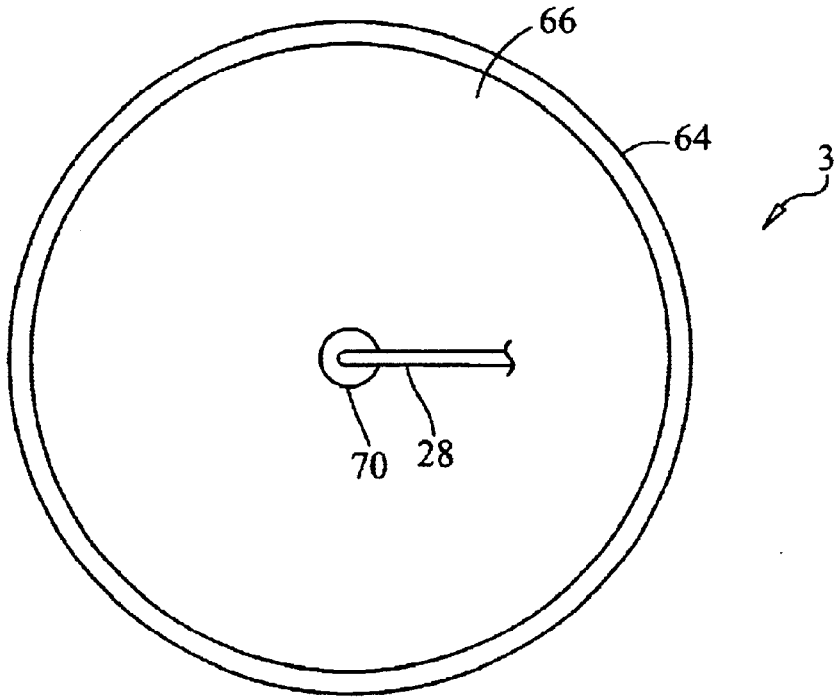
FIG. 10 is a top view of a third embodiment of a pull activated novelty sound device in accordance with the present invention.

With reference to FIGS. 9–10, a third embodiment of a pull activated novelty sound device 3 includes the sound generating chip 10, the sound transducer 12, a spring switch 14, a pull device 60, the battery 18, and a housing 62. The housing 62 includes a first housing half 64 and a second housing half 66. The sound generating chip 10, sound transducer 12, and the battery 18 operate in the same manner as they do in the pull activated novelty sound device 1. The spring switch 14 controls the electrical power supplied to the sound generating chip 10. The spring switch 14 includes a first spring leg 22 and a second spring leg 24.

The pull device 60 includes a ball insulator end 68, the lengthwise body 28, and the attachable end 30. The only difference between the pull device 16 and the pull device 60 is the ball insulator end 68. The ball insulator end 68 is a spherical object. One end of the lengthwise body 28 is preferably inserted through and retained by the ball insulator end 68 and the other end of the lengthwise body 28 is attached to the body end 34 with adhesive or any other suitable attachment method. Other methods of attaching the lengthwise body 28 to the ball insulator end 68 may also be used. The lengthwise body 28 is preferably a string, but other flexible materials may also be used.

With reference to FIG. 4, the first curved area 23 and second curved area 25 of the first and second spring legs are sized to receive the ball insulator end 68. A curved circumferential lead-in opening 70 is preferably formed in a top of the second housing half 66. The curved circumferential lead-in opening 70 allows the lengthwise body 28 to be withdrawn from the housing at a 90 degree angle. Normally, the first spring leg 22 contacts the second spring leg 24. However, when the insulator ball end 68 of the pull device 60 is inserted between the first spring leg 22 and the second spring leg 24, no electrical power flows to the sound generating chip 10; thus no message electrical signal is sent to the sound transducer 12.

The circuit board 21 is preferably attached to a top of the first housing half 64 and a peel-off adhesive 42 is attached to a bottom of the first housing half 64. A peel-off label 44 covers the adhesive surface of the peel off adhesive 42.

Figure 11:
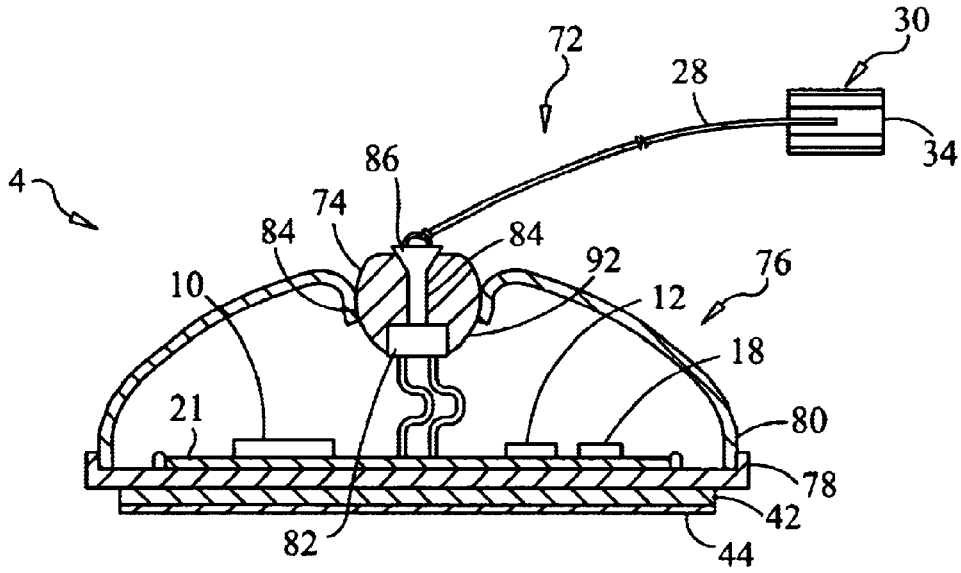
FIG. 11 is a cross sectional view of a fourth embodiment of a pull activated novelty sound device in accordance with the present invention.
Figure 12:
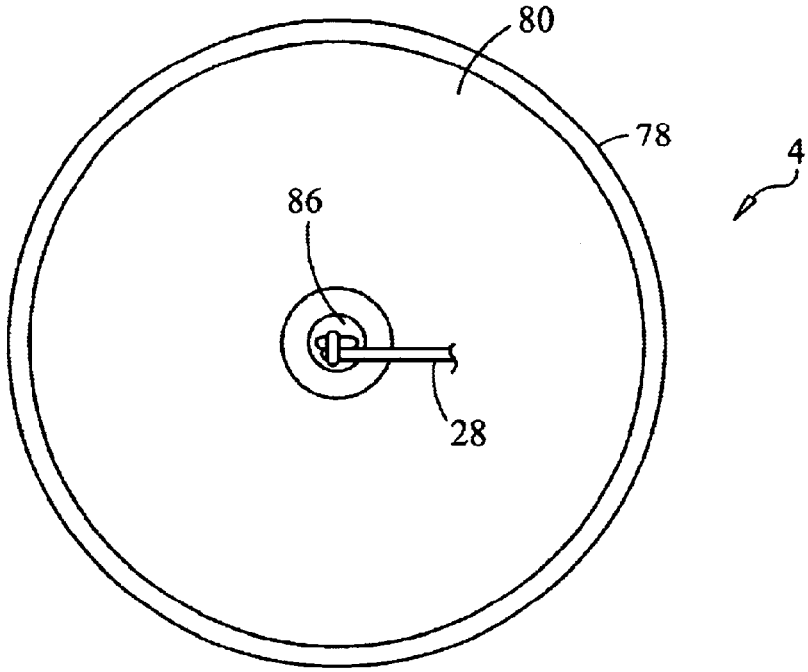
FIG. 12 is a top view of a fourth embodiment of a pull activated novelty sound device in accordance with the present invention.

With reference to FIGS. 11–12, a fourth embodiment of a pull activated novelty sound device 4 includes the sound generating chip 10, the sound transducer 12, a pull device 72, a pivoting retainer 74, the battery 18, and a housing 76. The housing 76 includes a first housing half 78 and a second housing half 80. The sound generating chip 10, sound transducer 12, and the battery 18 operate in the same manner as they do in the pull activated novelty sound device 1. The pivoting retainer 74 includes a normally closed electrical switch 82 disposed on a bottom of a shank opening 84. The normally closed electrical switch 82 controls the electrical power supplied to the sound generating chip 10. A pair of wires 83 from the normally closed switch 83 are electrically connected to the circuit board 21. However, other methods of electrically connecting the normally closed electrical switch 82 to the circuit board 21 may also be used.

Figure 17:
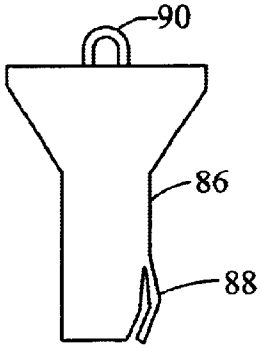
FIG. 17 is an enlarged side view of a plug end of a pull device of a pull activated novelty sound device in accordance with the present invention.
Figure 20:
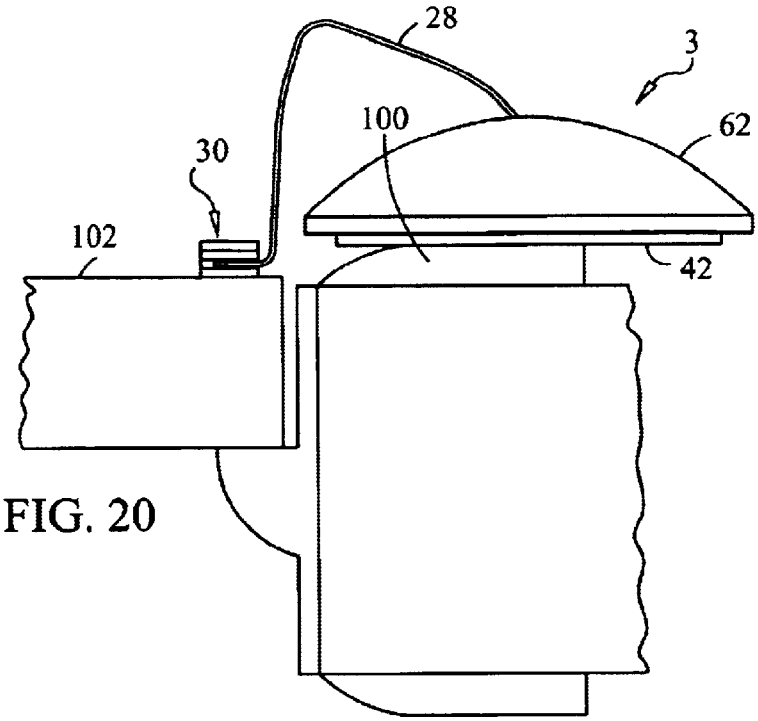
FIG. 20 is a side view of a third embodiment of a pull activated novelty sound device attached to a door and a molding adjacent the door before opening the door in accordance with the present invention.
Figure 21:
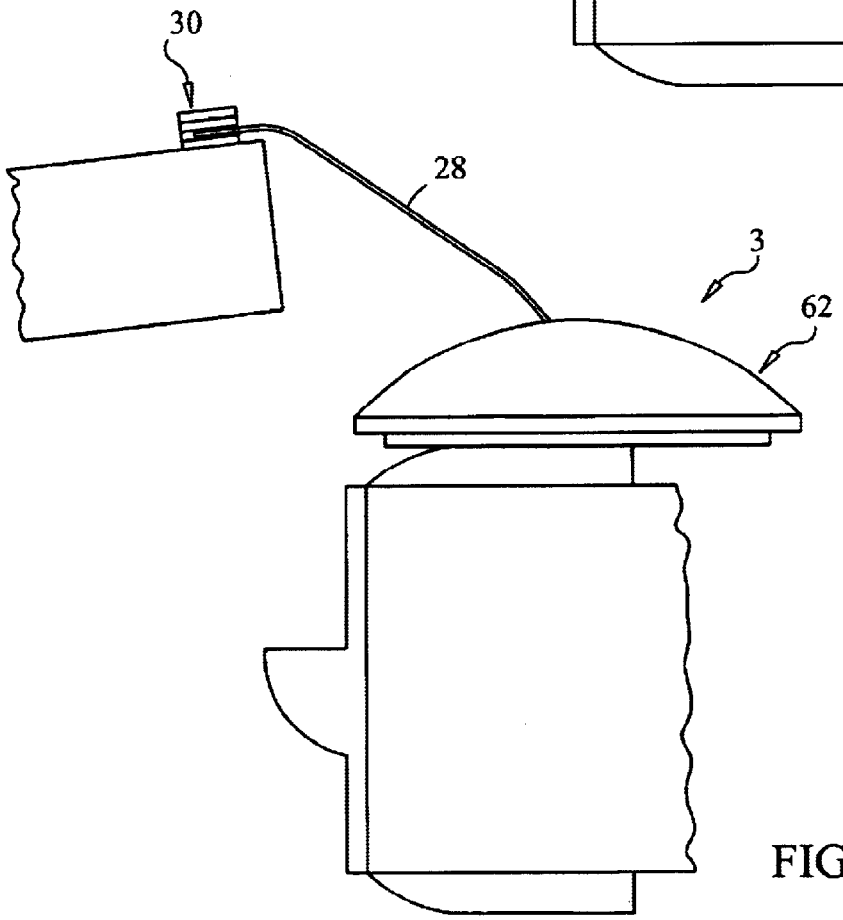
FIG. 21 is a side view of a third embodiment of a pull activated novelty sound device attached to a door and molding adjacent the door after opening the door in accordance with the present invention.

The pull device 72 includes a plug end 86, the lengthwise body 28, and the attachable end 30. The difference between the pull device 16 and the pull device 72 is the plug end 86. The plug end 86 is inserted into the shank opening 84 to depress the normally closed switch 82 such that there is an electrically open circuit. With reference to FIG. 17, the difference between the insulator end 26 and the plug end 86 is a projection member 88, which extends from a bottom of the plug insulator end 86. The plug end 86 also does not have to act as an insulator. The projection member 88 prevents the plug end 86 from falling out of the shank opening 84. However, other methods of retaining the plug end 86 in the shank opening 84 may also be used. One end of the lengthwise body 28 is preferably tied to an eye loop 90 formed on one end of the plug end 86 and the other end of the lengthwise body 28 is attached to the body end 34 with adhesive or any other suitable attachment method. Other methods of attaching the lengthwise body 28 to the plug end 86 may also be used such as adhesive. The lengthwise body 28 is preferably a string, but other flexible materials may also be used.

The pivoting retainer 74 is pivotally retained in a circumferential boss 92 formed at a top of the second housing half 80. The pair of wires 83 are longer than necessary to allow the pivoting retainer 74 to pivot relative to the circumferential boss 92 in any direction. The circuit board 21 is preferably attached to a top of the first housing half 78 and a peel-off adhesive 42 is attached to a bottom of the first housing half 78. A peel-off label 44 covers the adhesive surface of the peel off adhesive 42.

Figure 13:
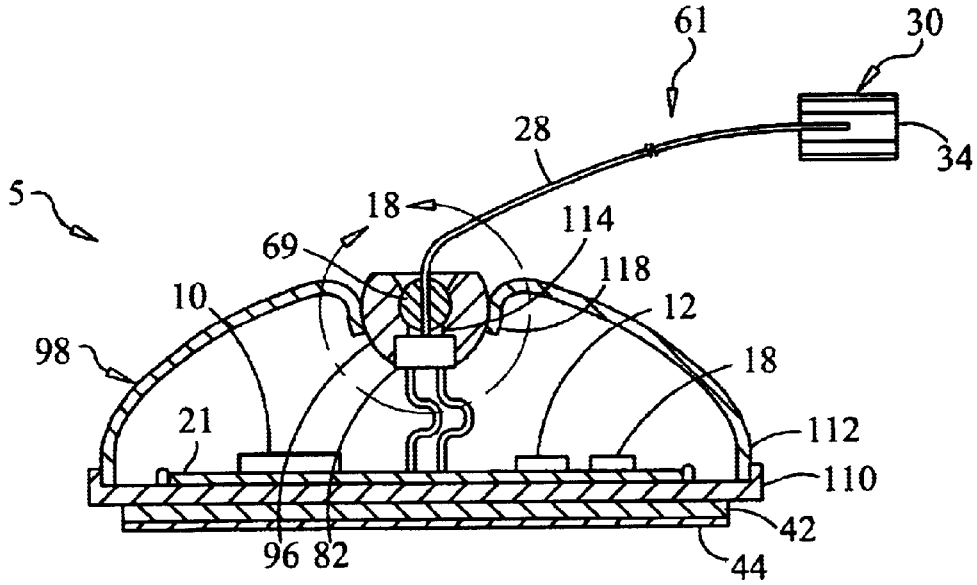
FIG. 13 is a cross sectional view of a fifth embodiment of a pull activated novelty sound device in accordance with the present invention.
Figure 14:
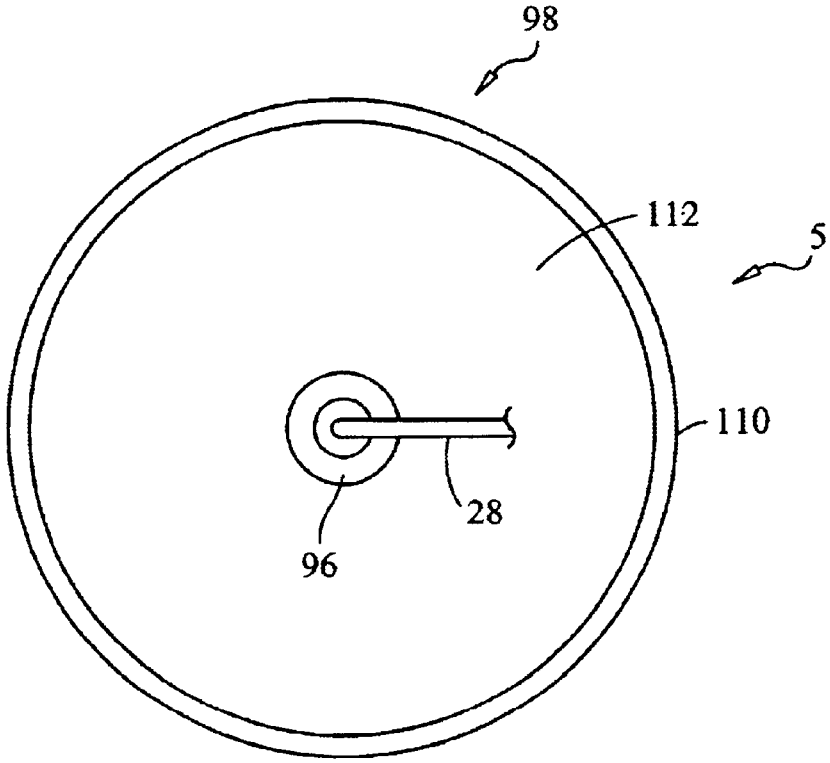
FIG. 14 is a top view of a fifth embodiment of a pull activated novelty sound device in accordance with the present invention.

With reference to FIGS. 13–14, a fifth embodiment of a pull activated novelty sound device 5 includes the sound generating chip 10, the sound transducer 12, a pull device 61, a pivoting retainer 96, the battery 18, and a housing 98. The housing 98 includes a first housing half 110 and a second housing half 112. The sound generating chip 10, sound transducer 12, and the battery 18 operate in the same manner as they do in the pull activated novelty sound device 1. The pivoting retainer 96 includes the normally closed switch 82 disposed on a bottom of a ball opening 114. The normally closed switch 82 controls the electrical power supplied to the sound generating chip 10.

Figure 18:
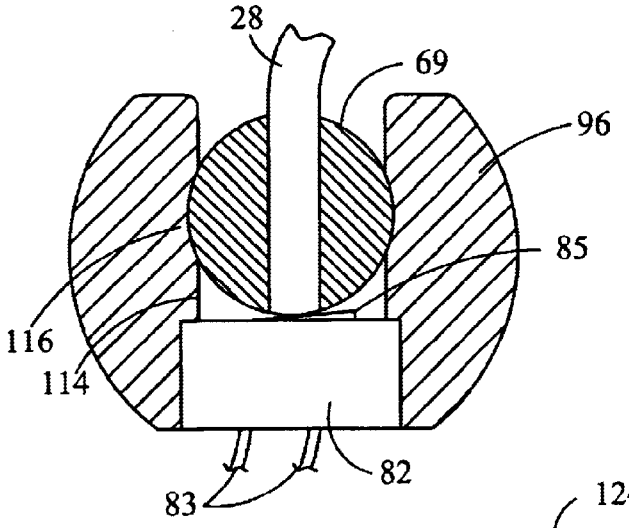
FIG. 18 is an enlarged cross sectional view of a ball end of a pull device retained in a ball pivot of a pull activated novelty sound device in accordance with the present invention.

The pull device 61 includes a ball end 69, the lengthwise body 28, and the attachable end 30. The difference between the pull device 16 and the pull device 61 is the ball end 69. The ball end 69 also does not have to act as an insulator. With reference to FIG. 18, the ball end 68 is inserted into the ball opening 114 until thereof fully depresses a switch lever 85 of the normally closed switch 82 such that thereof is electrically open. A retention groove 116 is preferably formed in a wall of the ball opening 114 to prevent the ball end 69 from falling out of the ball opening 114; when the pull activated novelty sound device 5 is turned upside down. However, other methods of retaining the ball end 69 may also be used. The pivoting retainer 96 is pivotally retained in a circumferential boss 118 formed at a top of the second housing half 112. The circuit board 21 is preferably attached to a top of the first housing half 110 and a peel-off adhesive 42 is attached to a bottom of the first housing half 110. A peel-off label 44 covers the adhesive surface of the peel off adhesive 42.

Figure 15:
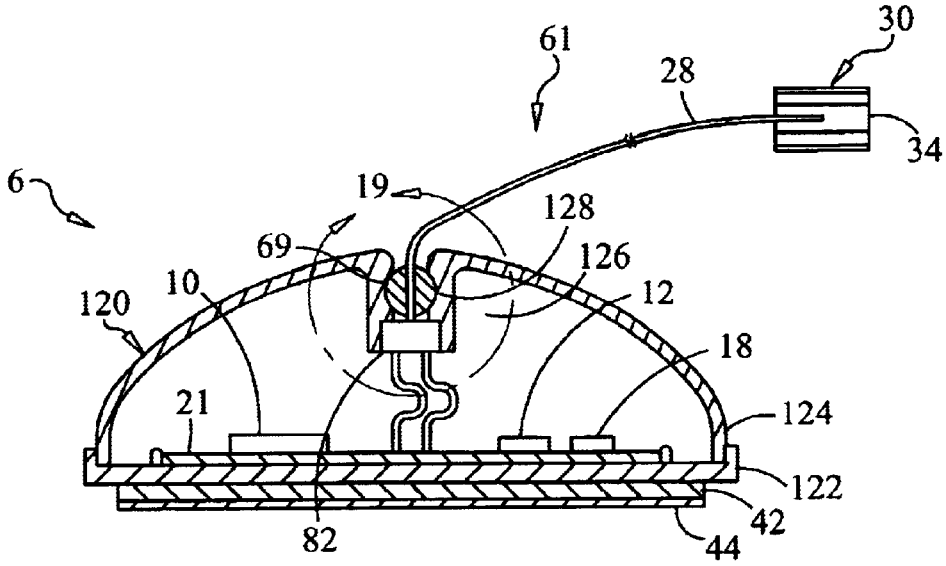
FIG. 15 is a cross sectional view of a sixth embodiment of a pull activated novelty sound device in accordance with the present invention.
Figure 16:
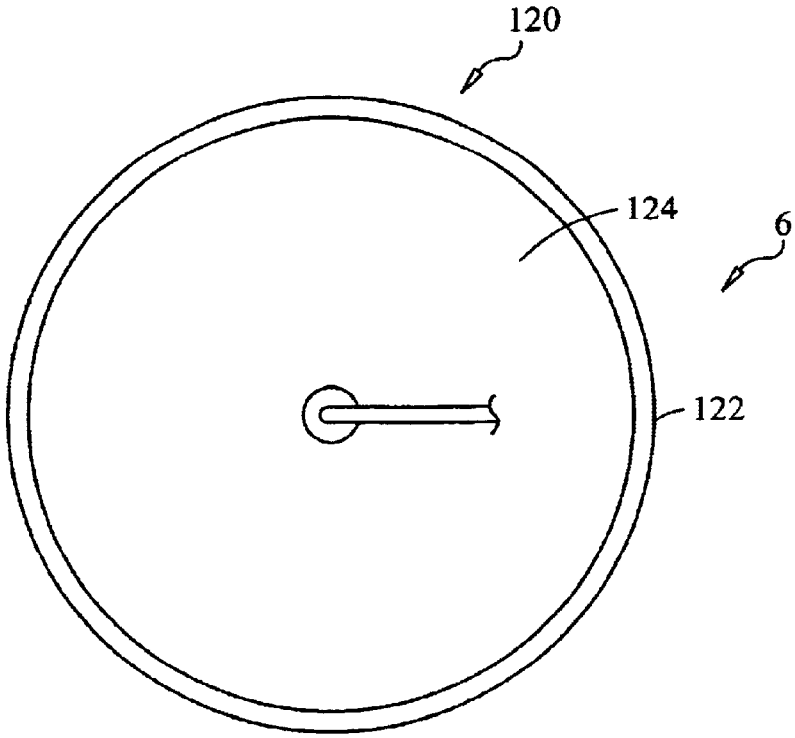
FIG. 16 is a top view of a sixth embodiment of a pull activated novelty sound device in accordance with the present invention.

With reference to FIGS. 15–16, a sixth embodiment of a pull activated novelty sound device 6 includes the sound generating chip 10, the sound transducer 12, the pull device 60, the battery 18, and a housing 120. The housing 120 includes a first housing half 122 and a second housing half 124. The sound generating chip 10, sound transducer 12, and the battery 18 operate in the same manner as they do in the pull activated novelty sound device 1.

Figure 19:
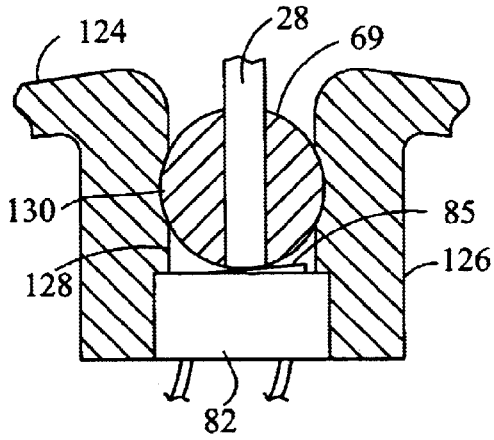
FIG. 19 is an enlarged cross sectional view of a ball end of a pull device retained in a second housing half of a pull activated novelty sound device in accordance with the present invention.

With reference to FIG. 19, a circumferential pivoting boss 126 is formed in the second housing half 124. The normally closed switch 82 is retained in a bottom of the pivoting boss 126. A ball opening 128 is formed through the pivoting boss 126 to receive the ball end 69. A retention groove 130 is preferably formed in a wall of the ball opening 128 to prevent the ball end 69 from falling out of the ball opening 128; when the pull activated novelty sound device 6 is turned upside down. However, other methods of retaining the ball end 69 may also be used. The normally closed switch 82 controls the electrical power supplied to the sound generating chip 10. The pull device 61 includes a ball end 69, the lengthwise body 28, and the attachable end 30. The difference between the pull device 14 and the pull device 60 is the ball end 69.

The circuit board 21 is preferably attached to a top of the first housing half 122 and a peel-off adhesive 42 is attached to a bottom of the first housing half 122. A peel-off label 44 covers the adhesive surface of the peel off adhesive 42.

With reference to FIGS. 9 and 10, the pull activated novelty sound devices 1–6 are preferably used in the following manner. However, only the pull activated novelty device 3 is illustrated in use. The peel-off label 44 is removed from the peel-off adhesive 42 and the housing 62 is attached to a first object such as a molding 100 adjacent a door 102. The peel-off adhesive 32 is removed from the attachable end 30. The attachable end 30 is fastened to a second object such as a door 102. However, other first and second objects besides the molding 100 and the door 102 may also be used. When the door 102 is opened, the ball end 68 will be pulled out of the spring switch 14. The sound generating chip 10 will send an electrical signal to the transducer chip 12 which will emit an audible sound, such as "I bet you thought I was hiding behind the door."

Figure 22:
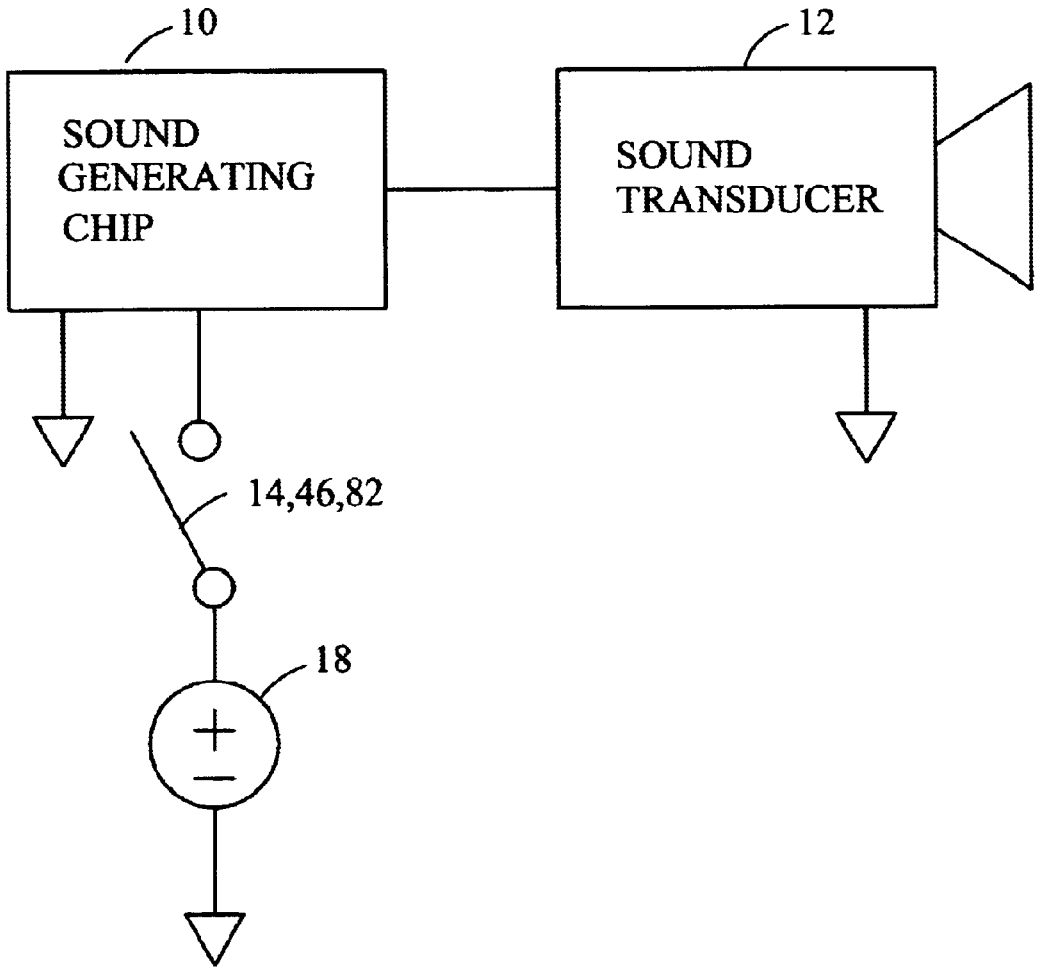
FIG. 22 is an electrical schematic diagram of first through sixth embodiments of a pull activated novelty sound device before thereof is actuated by closing an electrical switch in accordance with the present invention.

FIG. 22 shows an electrical schematic diagram of pull activated novelty sound devices 1–6. The spring switch 14,46 or the normally closed electrical switch 82 control electrical power from the battery 18 to the sound generating chip 10. The sound generating chip 10 supplies an electrical signal to the sound transducer 12. The sound transducer 12 produces an audible sound.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of activating an audible sound upon the moving of two objects relative to each other comprising the steps of:

providing a sound generating chip retained in a housing;

providing a sound transducer to generate said audible sound from said sound generating chip;

providing a pull device having a first end capable of being attached to a first object;

retaining a second end of said pull device in said housing, said second end having a round perimeter and curved side wall; and moving said first object away from said second object to withdraw said second end of said pull device from said housing to close an electrical circuit to activate the playing of said audible sound.

2. The method of activating an audible sound upon the moving of two objects relative to each other of claim 1, further comprising the step of:

providing a spring switch for retaining said second end of said pull device.

3. The method of activating an audible sound upon the moving of two objects relative to each other of claim 2, further comprising the step of:

providing said spring switch with a first spring leg and a second spring leg that normally contact each other.

4. The method of activating an audible sound upon the moving of two objects relative to each other of claim 1, further comprising the step of:

forming an insulating end on a second end of said pull device.

5. The method of activating an audible sound upon the moving of two objects relative to each other of claim 1, further comprising the step of:

forming a circumferential lead in opening in a top of said housing.

6. The method of activating an audible sound upon the moving of two objects relative to each other of claim 1, further comprising the steps of:

retaining pivotally a pivoting retainer in a top of said housing, retaining a normally closed switch in said pivoting retainer; and inserting a second end of said pull device into said pivoting retainer such that said normally closed switch is electrically opened.

7. The method of activating an audible sound upon the moving of two objects relative to each other of claim 1, further comprising the step of:

retaining a second end of said pull device in a circumferential pivoting boss, retaining a normally closed switch in said circumferential pivoting boss; and inserting a second end of said pull device such that said normally closed switch is electrically opened.

8. A method of activating an audible sound upon the moving of two objects relative to each other comprising the steps of:

providing a sound generating chip retained in a housing;

providing a sound transducer to generate said audible sound from said sound generating chip;

providing a pull device having a first end capable of being attached to a first object;

retaining a second end of said pull device in a retention groove of said housing, said second end having a round perimeter and curved side wall; and moving said first object away from said second object to withdraw said second end of said pull device from said spring switch to close an electrical circuit to activate the playing of said audible sound.

9. The method of activating an audible sound upon the moving of two objects relative to each other of claim 8, further comprising the step of:

forming a circumferential lead-in opening in a top of said housing.

10. A method of activating an audible sound upon the moving of two objects relative to each other comprising the steps of:

providing a sound generating chip retained in a housing;

providing a sound transducer to generate said audible sound from said sound generating chip;

providing a pull device having a first end capable of being attached to a first object;

retaining a second end of said pull device adjacent a switch, said second end having a round perimeter and curved side wall;

said switch being retained in said housing; and moving said first object away from said second object to withdraw said second end of said pull device from said housing to close an electrical circuit to activate the playing of said audible sound.

11. The method of activating an audible sound upon the moving of two objects relative to each other of claim 10, further comprising the step of:

retaining pivotally a pivoting retainer in a top of said housing, said pivoting retainer receiving a second end of said pull device.

* * * * *